United States Patent [19]

Palumbo

[11] Patent Number: 4,894,492

[45] Date of Patent: Jan. 16, 1990

[54] MOTOR CONTROL VARIABLE SPEED REVERSING SWITCH

[76] Inventor: Nicholas R. Palumbo, 28 Redwood Dr., Cumberland, R.I. 02864

[21] Appl. No.: 239,506

[22] Filed: Sep. 1, 1988

[51] Int. Cl.[4] ..... H01H 9/00

[52] U.S. Cl. ..... 200/1 V; 200/4

[58] Field of Search ..... 200/1 V, 4, 5 R, 6 R, 200/6 B, 6 BA, 11 J, 14, 18, 303; 318/280, 305; 388/827, 838

[56] References Cited

U.S. PATENT DOCUMENTS

| | | | |
|---|---|---|---|
| 3,140,689 | 7/1964 | Miner | 74/365 |
| 3,196,237 | 7/1965 | Westgate, Jr. | 200/303 X |
| 3,668,491 | 6/1972 | Kelley et al. | 318/305 |
| 4,273,971 | 6/1981 | Tregurtha | 200/4 |
| 4,518,832 | 5/1985 | Geremia | 200/4 |

OTHER PUBLICATIONS

Arkles Corp, T. Boebel, Blueprint of a Motor Control Switch, 1 sheet, date: 11-20-85.

*Primary Examiner*—J. R. Scott

*Attorney, Agent, or Firm*—Sylvia L. Boyd

[57] ABSTRACT

Rotary switch providing selectable forward and reverse motor speeds responsive to a single control. A rotatable shaft moves two power source contacts interdependently between a motor terminal and a bus, for two polarity conditions, or holds the contacts in a power off condition. Three concentric coplanar tracks, radially spaced and centered about the shaft axis, each comprises conductive and non-conductive arcuate segments. At least one track has a segment powered by connection to the bus. Each conductive segment of a non-powered track is connected to a switch output. The shaft carries two arcuately spaced wipers, each providing electrical contacts for connecting conductive segments of a distinct pair of tracks including a powered track. Segments, wipers, and contacts are mutually spaced to successively connect distinct sets of segments as the shaft is rotated, to provide at the switch outputs distinct switch conditions including an off condition. Each switch polarity condition provides a plurality of switch output conditions.

6 Claims, 7 Drawing Sheets

FIG. 9
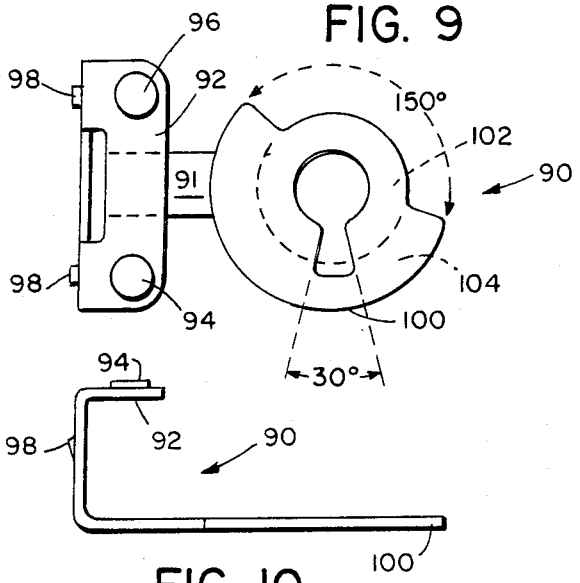
FIG. 10
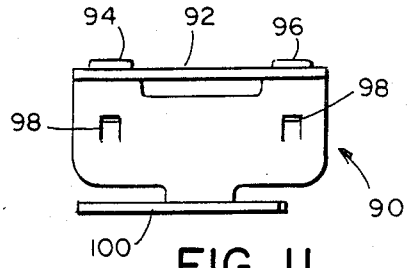
FIG. 11
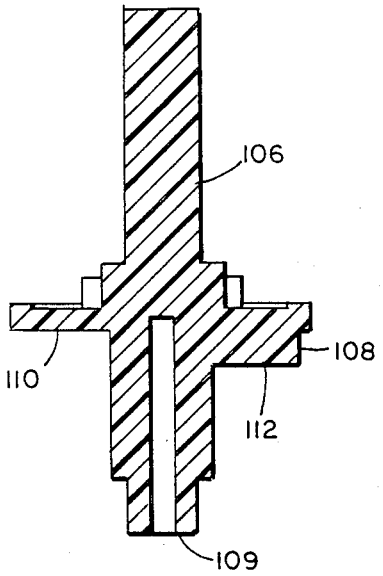
FIG. 12
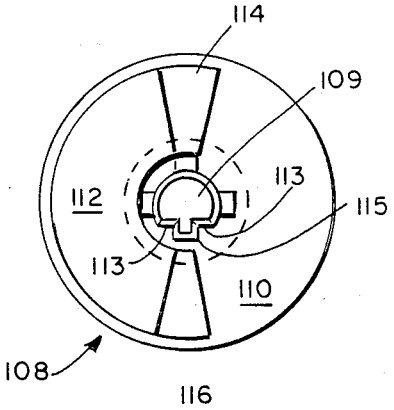
FIG. 13

MOTOR CONTROL VARIABLE SPEED REVERSING SWITCH

BRIEF SUMMARY OF INVENTION

The invention relates to switches for providing a plurality of selectable forward and reverse motor speeds, for use in controlling a motor powered by a direct current source, such as that used to power the propellor of a fishing boat. Such a switch must carry high current, about 30 to 35 amps, at about 12 to 24 volts DC.

It is desirable for such a switch to both reverse polarity (to reverse the motor) and select the motor speed. Attempts have been made to combine the control functions for actuation by a single control, by retrofitting independent switches with jumpers and with means to capture one control within another, for actuation by independent motions of the control in orthogonal directions. Such retrofitting is expensive, and the resulting control is awkward to use. Other attempts to provide the combined control function have employed conductive rivets which pass through plastic structures; such connections tend to be unreliable, loosening with time and leading to premature failure of the switch elements. Hitherto these functions have not been provided in a single switch, controllable by a control which moves in a single degree of freedom.

It is therefore desirable to provide a single switch for providing selectable forward and reverse motor speeds responsive to motion of a single control in a single degree of freedom.

It is also desirable to provide such a switch that is economical to manufacture and assemble, and reliable in use.

According to the invention, a rotary switch for interconnecting a motor, a direct current power source, and a resistor network, provides a plurality of selectable forward and reverse motor speeds responsive to displacement of a single control in a single degree of freedom. The switch comprises a case, a switch control, a shaft rotatable within the case about an axis, responsive to motion of the control, and a plurality of switch outputs. The switch further comprises two electrical conductors, each having a switch input portion fixed in the case for connection to the power source, and a movable portion; a source terminal fixed in the case and connected to one of the switch outputs for connection to the motor; and an integral switch bus having a polarity terminal and an axially spaced track terminal.

Cooperative reversal means are carried on the shaft and conductors for moving the two conductor movable portion contacts interdependently between the source terminal and the bus polarity terminal, for a first polarity condition and an opposite polarity condition, responsive to the shaft moving between two rotational conditions, and for holding the two conductor contacts in a power OFF condition, responsive to the shaft being in a third rotational condition.

Three circular tracks are disposed at three radially spaced positions centered about the shaft axis, each of the tracks comprising conductive and non conductive arcuate segments; at least one track conductive segment is the bus track terminal, defining a powered track. Each conductive segment of each track other than the powered track is connected to a switch output for connection to the resistor network. Two arcuately spaced electrical bridging elements are carried on the shaft, each providing three spaced electrically connected track contacts, the track contacts of a first bridging element being disposed for connecting at least two conductive segments of a first pair of tracks including a powered track, the track contacts of the other bridging element being disposed for connecting at least two conductive segments of a distinct pair of tracks including a powered track.

The track conductive segments, electrical bridging elements, and track contacts are mutually arcuately, axially and radially spaced such that, at successive spaced rotational positions of the shaft, the bridging elements successively connect distinct sets of conductive segments, successively to provide at the switch outputs a plurality of distinct switch output conditions including a switch output OFF condition. The bridging elements are arcuately spaced with respect to the reversal means such that a first plurality of switch output conditions is provided in the first polarity condition, a second plurality of switch output conditions is provided in the opposite polarity condition, and the switch output OFF condition is provided in the power OFF condition.

BRIEF DESCRIPTION OF THE DRAWING

FIGS. 9, 10 and 11 show the integral switch bus;

FIG. 12 shows the rotating shaft;

FIG. 13 shows the shaft end and shaft cam surfaces from below;

DETAILED DESCRIPTION

Figure 1:
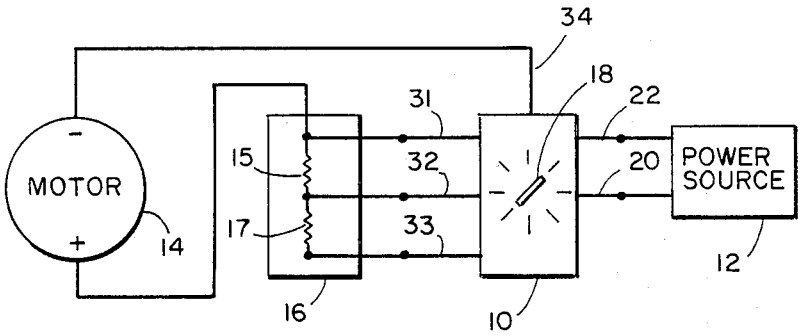
FIG. 1 is a schematic showing of the switch interconnected with a power source, a motor, and a resistor network.

Referring now to the drawings, and particularly to FIG. 1, a switch 10 is provided for interconnecting a direct current power source 12 with a motor 14 and a resistor network 16. The particular embodiment described herein is designed to be connected with a resistor network comprising two resistors 15 and 17. Switch 10 is controlled by control 18, which may be a knob on the exterior of switch 10, and which controls the state of switch 10 by displacements in a single degree of freedom, that of rotation control 18 can be turned to successive spaced rotational positions to select desired speeds of motor 14. Switch 10 has switch inputs 20 and 22 for connection to power source 12, and has four switch outputs 31, 32, 33, and 34 for connection to motor 14 and resistor network 16.

Figure 2:
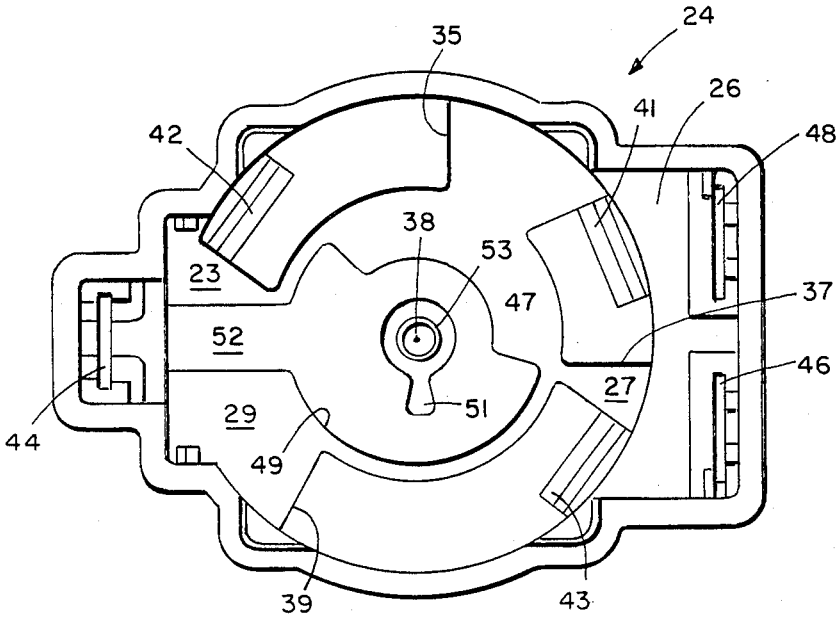
FIG. 2 is a view of the interior floor of the switch case.

Referring to FIG. 2, switch 10 comprises an insulating housing or case 24, desirably molded of glass reinforced polyester, having a floor 26, which may include portions at different levels. Provision is made in case floor 26 for the reception of conductive segments, to be described, which together with raised lands of floor 26 comprise three circular tracks, concentric about a center point 38 and spaced at successively greater radii from center 38. For reception of conductive segments of the innermost and middle tracks, a depression 49 is formed in floor 26 surrounding center 38; a keyhold portion 51 is raised above the level of depression 49. A pin 53 extends above the level of keyhole portion 51. A land 47 provides two arcuate portions of different radii, which function as non conductive segments of two tracks, as will be described. Depression 49 further provides a lead-in portion 52.

Still referring to FIG. 2, for reception of the conductive segments of the outermost track, three depressions 35, 37, and 39 are provided in floor 26; associated with depressions 37, 35 and 39 respectively are slots 41, 42 and 43, extending through floor 26, to accommodate switch outputs 31, 32 and 33. Depressions 37, 35 and 39 are separated by lands 23, 47, 27, and 29 of nonconductive case material.

Case 24 further provides two slots 46, 48 extending through floor 26 for the reception of switch inputs 20, 22 to be connected to power source 12, and a further slot 44 extending through floor 26 for the reception of switch output 34, as will be described. The portions of floor 26 in which slots 44, 46, and 48 are provided may be at a different level from the remainder of floor 26.

Figure 3:
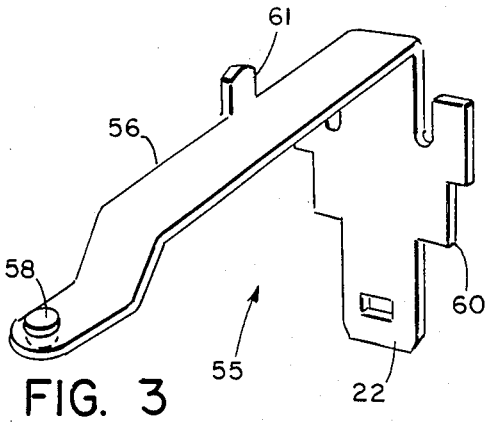
FIG. 3 shows one of the electrical conductors of the switch, comprising a movable spring contact portion and a tab portion.

Referring to FIG. 3, an electrical conductor 55, desirably stamped of copper alloy such as brass or phosphor bronze, which may be silver-plated, comprises a movable spring portion 56 carrying a contact 58, desirably of silver; contact 58 may be a silver rivet or welded silver point. Conductor 55 further comprises an integrally formed tab portion 60, adapted to be fixed in slot 48 of case 24; end 20 of tab portion 60 functions as switch input 20 to be connected to power source 12. Movable portion 56 carries a cam follower 61, bent upward on its right edge as seen from tab portion 60. Two conductors 55 are employed in the switch; both are visible in FIGS. 17 and 18. The second conductor tab portion end functions as switch input 22.

Figure 4:
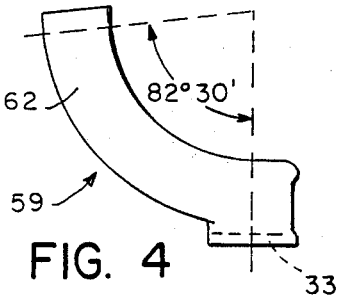
FIGS. 4, 5, 6 and 7 show certain of the conductive segments of the switch.
Figure 6:
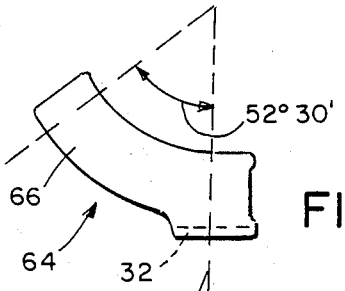
Figure 5:
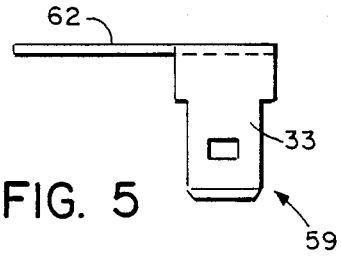
Figure 7:
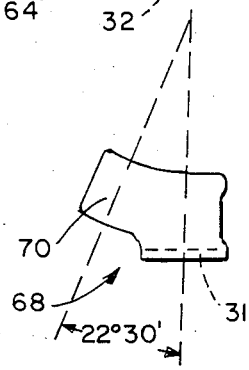

Referring to FIGS. 4 and 5, a first electrically conductive terminal 59 has a flat arcuate portion 62 and a tab portion 33 bent downwardly at 90 degrees from flat portion 62, to function as switch output 33 to resistor network 16 (FIG. 1) when terminal 59 is assembled in the switch. A second terminal 64 (FIG. 6) has a similar tab portion 32 which functions as switch output 32 (FIG. 1) but its flat arcuate portion 66 subtends a smaller angle. A third terminal 68 (FIG. 7) has a similar tab portion 31 which functions as switch output 31 (FIG. 1) but its flat arcuate portion 70 subtends a smaller angle than that of segment 64. Terminals 59, 64 and 68 are desirably stamped of copper alloy.

Terminals 59, 64 and 68 are adapted to be fitted within molded depressions 39, 35 and 37 respectively in case floor 26. Tab 33 is received in slot 43; tab 32 is received in slot 42; tab 31 is received in slot 41. The three tabs thus extend through floor 26 for connection to resistor network 16 as seen in FIG. 1.

Figure 8:
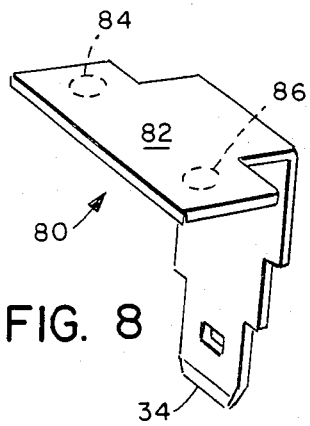
FIG. 8 shows a source terminal of the switch.

Referring now to FIG. 8, a source terminal 80, stamped of copper or copper alloy, provides a tab portion 34 adapted to be received in slot 44 of case 24 and to extend through floor 26 for connection to motor 14 (FIG. 1). Terminal 80 further provides a flat portion 82 at right angles to tab portion 34, carrying on its under side a pair of silver contacts 84, 86. Contacts 84, 86 may be silver rivets or welded silver point; alternatively terminal 80 may be silver plated, and contacts 84, 86 may be extruded.

Referring now to FIGS. 9, 10 and 11, an integral (one-piece) switch bus 90, desirably stamped of copper or copper alloy, provides a polarity terminal portion 92, carrying on its upper surface a pair of silver contacts 94, 96. Contacts 94, 96 may be silver rivets or welded silver point; alternatively bus 90 may be silver plated, and contacts 94, 96 may be extruded. The spacing between contacts 94, 96 and between contacts 84, 86 of source terminal 82 (FIG. 8) is the same. Two tangs or lances 98 are provided for fixing bus 90 in case 24. Integral switch bus 90 further provides track terminal 100, axially spaced from polarity terminal 92, and extending generally parallel therewith. Track terminal 100 is formed to fit within depression 49 of case floor 26 (FIG. 1), with bus lead-in portion 91 received in depression lead-in portion 52.

Referring to FIG. 12, a nonconductive shaft 106 carries an integrally molded nonconductive cam 108. Cam and shaft are molded of engineering plastic, such as molydisulphide reinforced nylon. As seen in FIG. 13, cam surface 108 comprises four lobes or lands, 110, 112, 114 and 116. Lands 114 and 116 are 180 degrees apart and are of equal height, intermediate between lands 110 and 112. As seen in FIG. 13, the bottom 109 of shaft 106 is keyed at 115, with adjacent flats 113.

Figure 14:
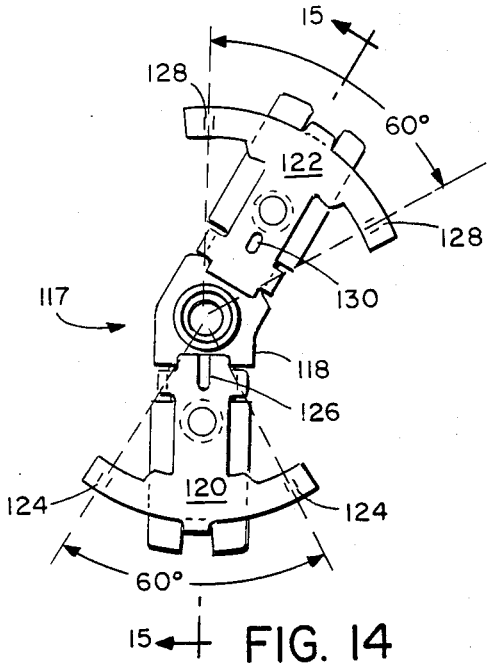
FIGS. 14 and 15 show the switch wiper holder and wipers assembled together, seen from below.
Figure 15:
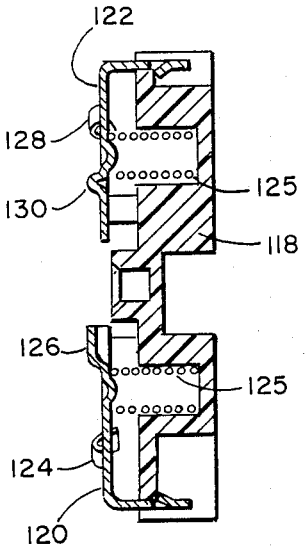

A wiper section 117 is affixed to the bottom of shaft 106, its orientation being determined by engagement with key 115 and flats 113. Referring to FIGS. 14 and 15, wiper section 117 comprises a nonconductive wiper holder 118, desirably molded of polyester, which carries two conductive wipers of bridging elements: inside wiper 120 and outside wiper 122. Each wiper 120, 122, is preferably stamped of copper alloy and is adapted to be retained on holder 118, as seen in FIG. 15.

Inside wiper 120 provides a track contact 126, adapted to ride (in assembled condition of the switch) on track terminal portion 102 of bus 90 and on keyhole portion 51 of case floor 26 (FIG. 2); and, radially spaced from contact 126, two arcuately spaced track contacts 124 adapted to ride on conductive segments 62, 66, and 70 and on nonconductive lands 23, 47, 27, and 29 of case floor 26 (FIG. 2).

Outside wiper 122 provides a track contact 130, adapted to ride (in assembled condition of the switch) on track terminal portion 104 of bus 90 and on land 47 of case floor 26; and, radially spaced from contact 130, two arcuately spaced track contacts 128 adapted to ride on conductive segments 62, 66 and 70 and nonconductive lands 23, 47, 27, and 29 of case floor 26.

Between each wiper and holder 118 a compression coil spring 125 is captured to bias the wiper and contacts downwardly from holder 118, each spring being closely adjacent to the respective radially spaced contact 126 or 130.

To assemble the switch, terminals 59, 64 and 68 are assembled to case 24, by placing respective tabs 33, 32, and 31 through slots 43, 42 and 41, and staking the tabs to fix the terminals in the case. Next, integral bus 90 is assembled to case 24, by placing track terminal 100 within case floor depression 49, and engaging lances 98 with cooperating structure in the wall of case 24 to fix bus 90 in place.

Figure 20:
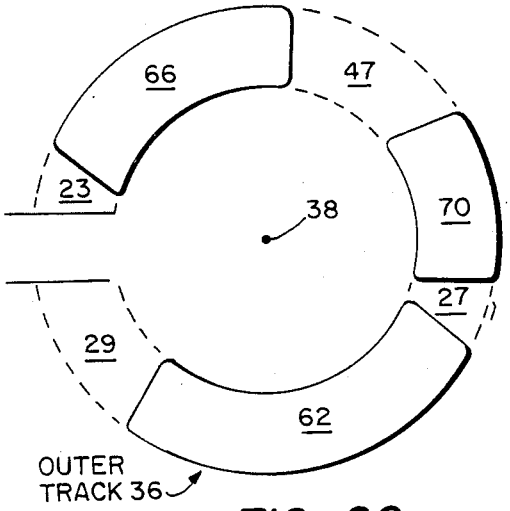
FIGS. 20, 21, and 22 schematically illustrate the conductive and non conductive segments of the three switch tracks in assembled condition of the switch.
Figure 21:
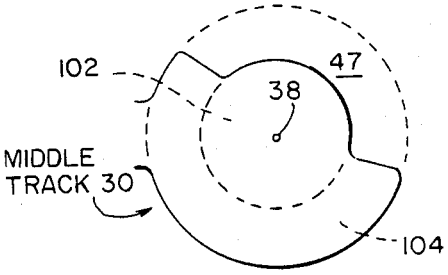
Figure 22:
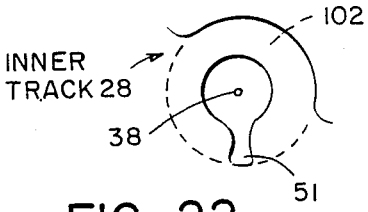

Referring to FIGS. 20, 21 and 22, the assembled switch provides three tracks 28, 30 and 36. Inner track 28 comprises conductive segment 102 of track terminal portion 100 of bus 90, interrupted by a thirty-degree nonconductive keyhole portion 51 of case floor 26. Middle track 30 comprises conductive segment 104 of track terminal portion 100 of bus 90, subtending 210 degrees; the remaining 150 degrees of track 30 are provided by nonconductive land 47 of case floor 26. Outer track 36 comprises conductive segments 66, 70, and 62, separated by nonconductive segments provided as lands 23, 47, 27 and 29 in case floor 26. It will be observed that lead-in portion 91 of bus 90 lies within the outline of outer track 36, but in the described embodiment portion 91 is not functionally part of track 36, as no connection is necessarily made through it.

Next, wiper section 117 is assembled by fixing wipers 120 and 122 to wiper holder 118. Section 117 is set in place on pin 38 of floor 26. Tabs 60 of the two conductors 55 are then placed in slots 46 and 48, and tab 34 of source terminal 80 is placed in slot 44; elements 55 and 80 are fixed in the case by staking.

Figure 16:
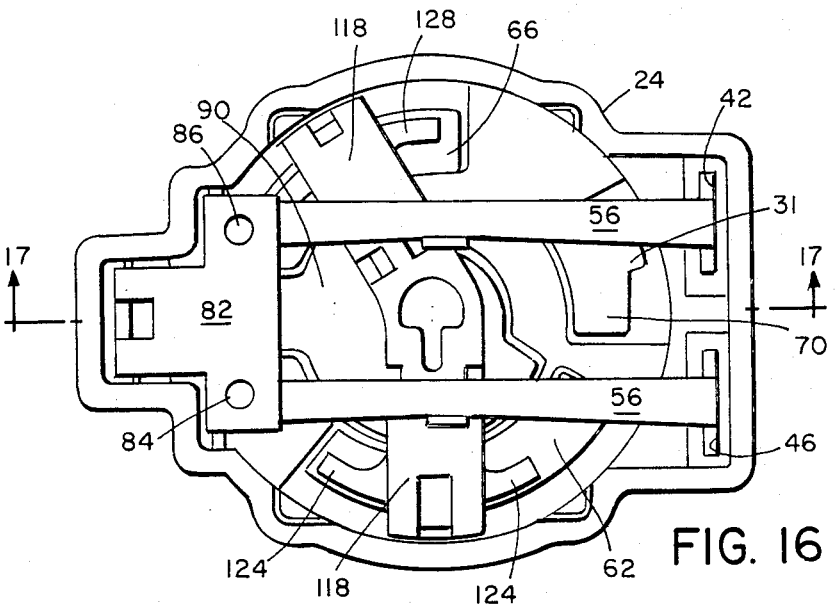
FIGS. 16 and 17 show the switch at a stage of assembly without the shaft and cam.
Figure 17:
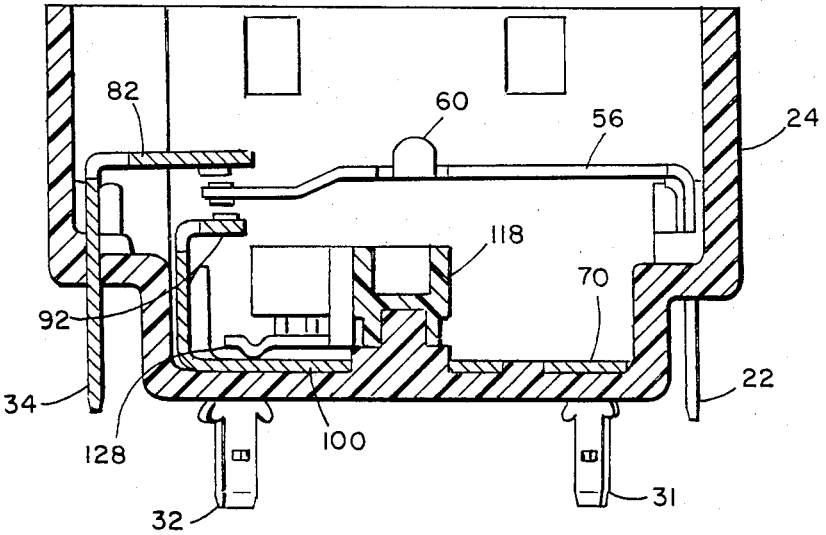

This stage of assembly is shown in FIGS. 16 and 17; the two conductors 55, the three terminals 59 (segment 62), 64 (segment 66) and 68 (segment 70), conductive structure 90 (track terminal portion 100 and polarity terminal portion 92), source terminal 80, and wiper section 117 are shown in assembled condition in case 24.

Next, shaft 106, with cam 108 and integrally molded detent spline carrier 140 (seen in FIG. 18), is keyed to wiper section 117. The keying ensures the correct arcuate spacing between detent spline carrier 140, the lands of cam 108 and the wipers 120 and 122. Detent spring 142 is placed over shaft 106, and is supported by suitable structure in case 24. Detent structures 140 and 142 provide successive rotational positions of the shaft spaced apart by 30 degrees. A cover 144 is then ultrasonically welded to case 24, closing the switch. Control 18 may be affixed to shaft 106, whose end protrudes through cover 144.

Figure 18:
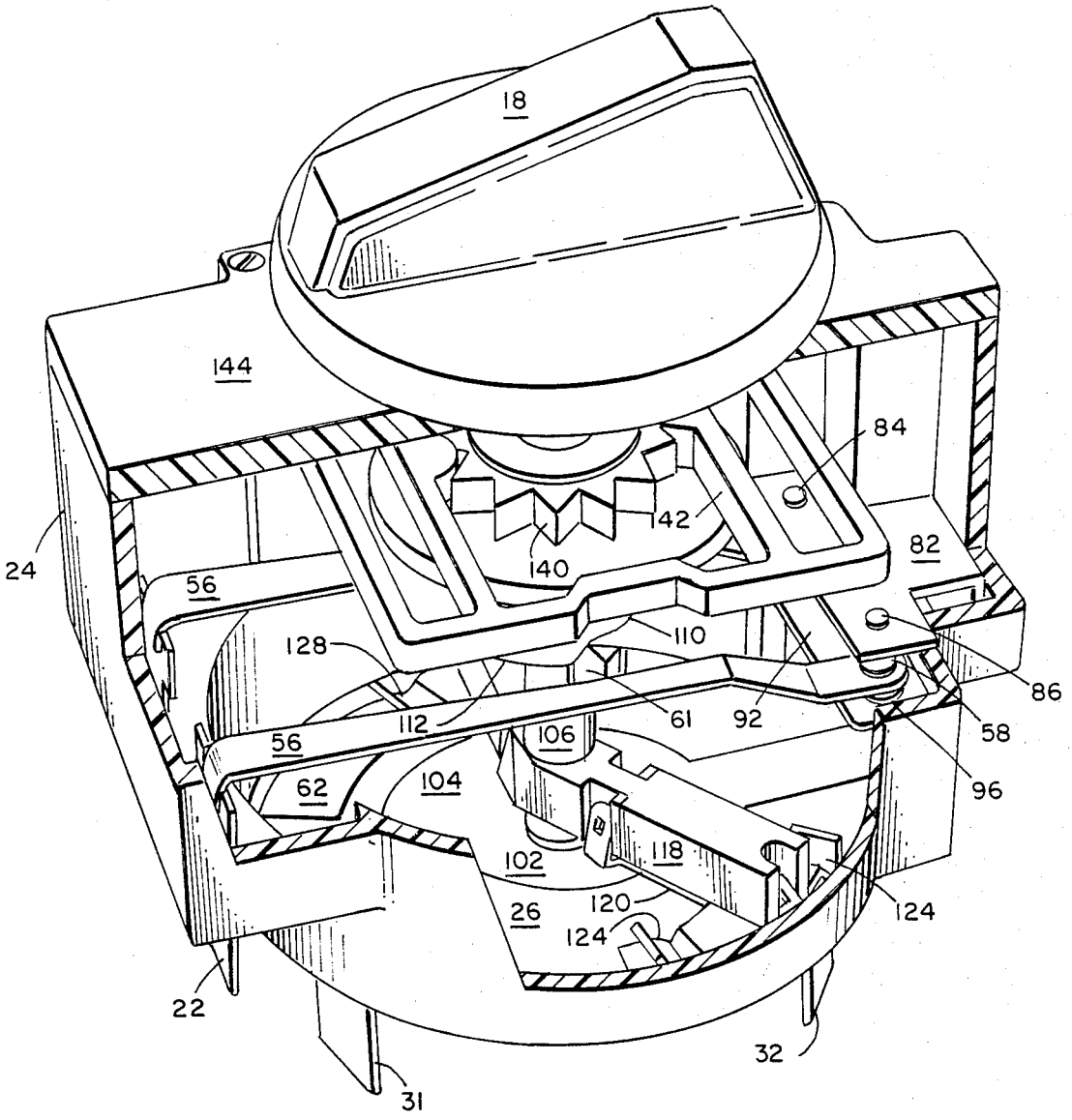
FIG. 18 is a perspective view of the assembled switch, partially cut away.

The complete assembled switch is shown in FIG. 18. While not designed to operate immersed in water, the switch is designed to function reliably in a damp environment.

In operation, contacts 124 of inside wiper 120 are disposed to contact the segments of outer track 36, and contact 126 is disposed to contact the segments of inner track 28, including conductive segment 102 which, being an integral part of bus 90, is electrically connected with its polarity terminal 92. Inner track 28 is therefore a powered track. Thus these three contacts can connect at least two conductive segments of a first pair of tracks including a powered track.

Contacts 128 of outside wiper 122 are disposed to contact segments of the outer track 36, and contact 130 is disposed to contact segments of middle track 30, including conductive segment 104 which, being an integral part of bus 90, is electrically connected with its polarity terminal 92. Middle track 30 is therefore a powered track. Thus these three contacts can connect at least two conductive segments of a distinct pair of tracks including a powered track. As seen in the figures, the arcuate, axial and radial spacings of the conductive segments of the three tracks, of the inside and outside wipers and of their contacts are such that at successive spaced rotational positions of shaft 106, determined by detent structures 140, 142 and responsive to control 18, distinct sets of conductive segments are successively connected, successively to provide at switch outputs 31, 32, 33 and 34 a plurality of distinct switch output conditions. The distinct switch output conditions include a switch output OFF condition.

Cam followers 61 of conductors 55 are urged against cam 108 by spring arms 56. The positions of arms 56 are interdependent. When followers 61 bear against lands 114, 116, contacts 58 are held spaced between contacts 84, 86 of source terminal 80 and contacts 94, 96 of polarity terminal 92. This is a power OFF condition. In all other rotational conditions of shaft 106, one cam follower 61 engages land 110, such that the corresponding contact 58 is permitted to engage a contact of source terminal 80, while the other cam follower 61 engages 1 and 112, such that the other contact 58 is held in engagement with a contact of polarity terminal 92. This polarity condition is reversed by rotation of cam 108 past the power OFF position.

Wipers 120, 122 are arcuately spaced on shaft 106 with respect to the lands of cam 108, and with respect to detent spine 140, such that a first plurality of switch output conditions is provided in a first polarity condition, a second plurality of switch output conditions is provided in a second polarity condition, and the switch output OFF condition is provided in the power OFF condition.

Figure 19:
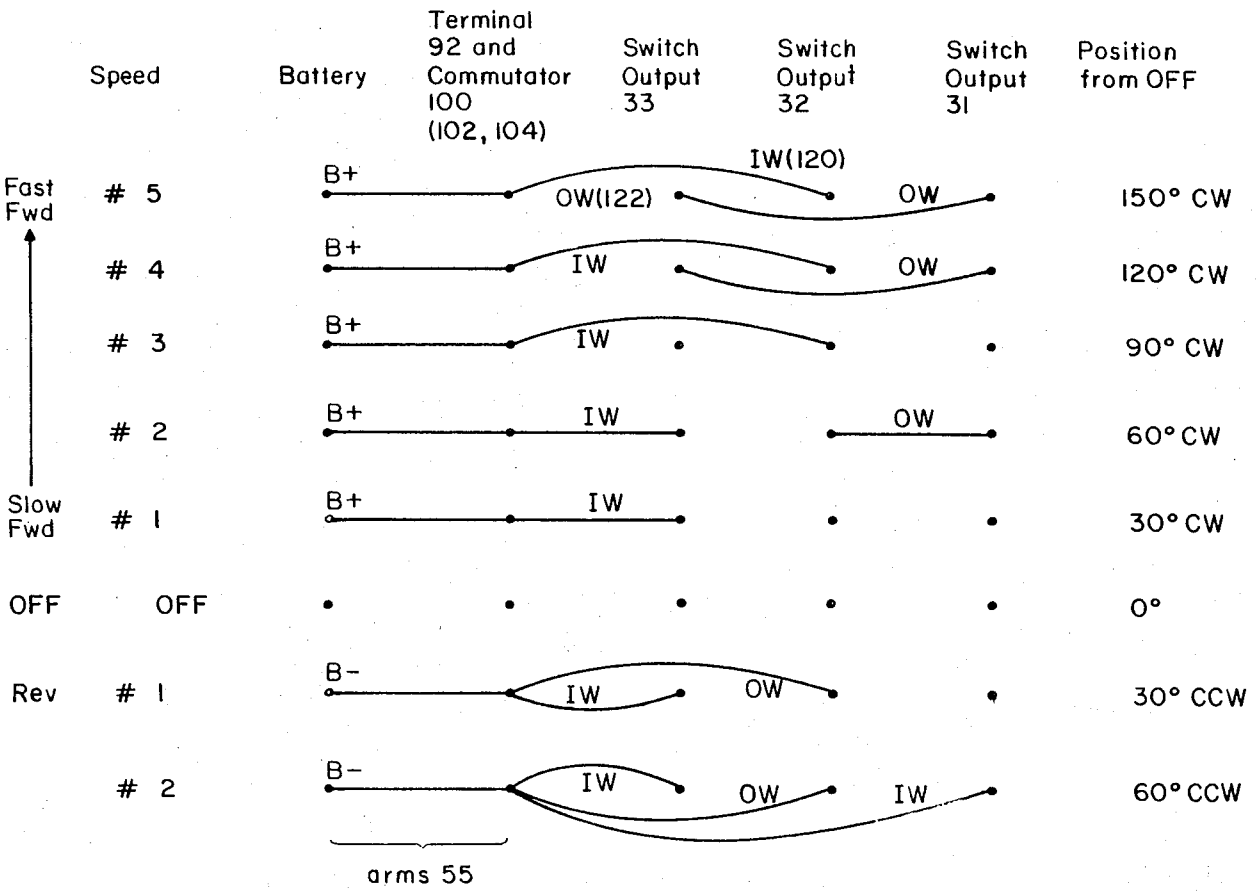
FIG. 19 shows the selectable speeds of the switch, with the internal switch conditions for each speed.

The distinct switch output conditions are shown schematically in FIG. 19. In the OFF condition, no power is provided at the switch outputs. There are five forward speeds. In the lowest forward speed, inner wiper (IW) 120 connects powered segment 102 of inner rack 28 and segment 62 of outer track 36 to energize output 33. In the next forward speed, inner wiper 120 continues in this condition, while outer wiper (OW) 122 connects segment 66 and segment 70 of outer track 36. Thus switch outputs 32 and 31 are connected in series with resistor 15 of network 16 (FIG. 1). In the third forward speed, IW 120 connects segment 102 of (powered) inner track 28 and segment 66 of outer track 36, while OW 122 contact 130 rides on the nonconductive segment of middle track 30. In the fourth forward speed, the inner wiper connection continues as in the third speed, but the outer wiper 122 contects conductive segments 62 and 66 of outer track 36, to connect outputs 33 and 32 in series with resistor 17 of network 16 (FIG. 1). In the fifth forward speed, the connections of the fourth speed are maintained, and additionally, OW 122 contact 130 connects with conductive segment 104 of (powered) middle track 30, to energize switch outputs 33 and 31.

In the described embodiment, two reverse speeds are provided. In the lower reverse speed, IW 120 connects conductive segment 102 of powered inner track 28 and conductive segment 62 of outer track 36 to energize switch output 33, and OW 122 connects conductive segment 104 of powered middle track 30 and conductive segment 66 of outer track 36 to energize switch output 32. In the higher reverse speed, these connections are maintained, and additionally IW 120 connects segment 102 and conductive segment 70 of outer track 36 to energize switch output 31.

Three additional reverse speeds, not described, are provided by the switch. A control stop may be provided to prevent selection of these speeds, if they are not desired.

What is claimed is:

1. A rotary switch for interconnecting a motor, a direct current power source, and a resistor network, providing a plurality of selectable forward and reverse motor speeds responsive to displacement of a single control in a single degree of freedom, comprising:

a case, a switch control supported by said case, a shaft rotatable within said case about an axis, responsive to motion of said control, and a plurality of switch outputs supported by said case, two electrical conductors, each having a switch input portion fixed in said case for connection to said power source, and a movable portion providing a contact, a source terminal fixed in said case and connected to one of said switch outputs for connection to said motor, an integral switch bus having a polarity terminal and an axially spaced track terminal, cooperative reversal means carried on said shaft and said conductors for moving said two conductor movable portion contacts interdependently between said source terminal and said bus polarity terminal, for a first polarity condition and an opposite polarity condition, responsive to said shaft moving between two rotational conditions, and for holding said two conductor contacts in a power OFF condition, responsive to said shaft being in a third rotational condition, three circular tracks disposed at three radially spaced positions centered about said axis, each of said tracks comprising conductive and non conductive arcuate segments, at least one said track conductive segment being said bus track terminal, defining a powered track, each said conductive segment of each track other than said powered track being connected to a said switch output for connection to said resistor network, two arcuately spaced electrical bridging elements carried on said shaft, each said bridging element providing three spaced electrically connected track contacts, said contacts of a first said bridging element being disposed for connecting at least two said conductive segments of a first pair of said tracks including a said powered track, said contacts of the other said bridging element being disposed for connecting at least two said conductive segments of a distinct pair of said tracks including a said powered track, said track conductive segments, said electrical bridging elements, and said track contacts being mutually arcuately, axially and radially spaced such that, at successive spaced rotational positions of said shaft, said bridging elements successively connect distinct sets of said conductive segments, successively to provide at said switch outputs a plurality of distinct switch output conditions including a switch output OFF condition, said bridging elements being arcuately spaced with respect to said reversal means such that a first plurality of said switch output conditions is provided in said first polarity condition, a second plurality of said switch output conditions is provided in said opposite polarity condition, and said switch output OFF condition is provided in said power OFF condition.

2. The switch of claim 1, further comprising detent structure for defining detented stable positions of said control, determining said successive spaced rotational positions of said shaft.

3. A switch for interconnecting a motor, a direct current power source, and a resistor network, providing a plurality of selectable forward and reverse motor speeds responsive to displacement of a single control in a single degree of freedom, comprising:

a case, a switch control supported by said case, and a plurality of switch outputs supported by said case, two electrical conductors, each having a switch input portion fixed in said case for connection to said power source, and a movable portion providing a contact, a source terminal fixed in said case and connected to one of said switch outputs for connection to said motor, an integral switch bus, reversal means for connecting said two conductor movable portion contacts to said source terminal and said bus in either of two polarity conditions responsive to two positions of said control, three parallel tracks disposed at three distinct positions, each of said tracks comprising conductive and non conductive segments, said bus providing at least one said track conductive segment, defining a powered track, each said conductive segment of each track other than said powered track being connected to a said switch output for connection to said resistor network, two spaced electrical bridging elements movable with respect to said tracks responsive to displacement of said control, each said bridging element providing three spaced electrically connected track contacts, said contacts of a first said bridging element being disposed for connecting at least two said conductive segments of a first pair of said tracks including a said powered track, said contacts of the other said bridging element being disposed for connecting at least two said conductive segments of a distinct pair of said tracks including a said powered track, said track conductive segments, said electrical bridging elements, and said track contacts being mutually spaced such that, at successive spaced positions of said control, said bridging elements successively connect distinct sets of said conductive segments, successively to provide at said switch outputs a plurality of distinct switch output conditions including a switch output OFF condition, said bridging elements being connected to said reversal means for common movement responsive to said control such that a first plurality of said switch output conditions is provided in said first polarity condition, a second plurality of said switch output conditions is provided in said opposite polarity condition, and said switch output OFF condition is provided in said power OFF condition.

4. A switch for interconnecting a motor, a direct current power source, and a resistor network, providing a plurality of selectable forward and reverse motor speeds responsive to displacement of a single control in a single degree of freedom, comprising:

a case, a switch control supported by said case, and a plurality of switch outputs supported by said case, an integral switch bus connectible with said power source, three parallel tracks disposed at three distinct positions, each of said tracks comprising at least one conductive segment, said bus providing at least one said track conductive segment, defining a powered track, each said conductive segment of each track other than said powered track being connected to a said switch output for connection to said resistor network, two spaced electrical bridging elements movable with respect to said tracks responsive to displacement of said control, each said bridging element providing three spaced electrically connected track contacts, said track contacts of a first said bridging element being disposed for connecting a first pair of said tracks including a said powered track, said track contacts of the other said bridging element being disposed for connecting a distinct pair of said tracks including a said powered track, said track conductive segments, said electrical bridging elements, and said track contacts being mutually spaced such that, at successive spaced positions of said control, said bridging elements successively connect particular said output terminals and said bus, successively to provide at said switch outputs a plurality of distinct switch output conditions including a switch output OFF condition.

5. The switch of claim 1, said switch bus, said circular tracks, and said bridging elements being located within said case.

6. The switch of claim 4, said switch bus, said parallel tracks, and said bridging elements being located within said case.

* * * * *